US009416497B2

(12) United States Patent
Säckler et al.

(10) Patent No.: US 9,416,497 B2
(45) Date of Patent: Aug. 16, 2016

(54) DEVICE FOR FASTENING A RAIL TO A CARRIER

(71) Applicant: RAIL.ONE GMBH, Neumarkt (DE)

(72) Inventors: Robert Säckler, Lappersdorf (DE); Hans-Christian Rossmann, Berlin (DE)

(73) Assignee: RAIL.ONE GMBH, Neumarkt (DE)

( * ) Notice: Subject to any disclaimer, the term of this patent is extended or adjusted under 35 U.S.C. 154(b) by 0 days.

(21) Appl. No.: 14/411,976

(22) PCT Filed: Jun. 10, 2013

(86) PCT No.: PCT/EP2013/061872

§ 371 (c)(1),
(2) Date: Dec. 30, 2014

(87) PCT Pub. No.: WO2014/005796

PCT Pub. Date: Jan. 9, 2014

(65) Prior Publication Data

US 2015/0337499 A1 Nov. 26, 2015

(30) Foreign Application Priority Data

Jul. 5, 2012 (DE) ..... 10 2012 013 286

(51) Int. Cl.

| | |
|---|---|
| ***E01B 9/00*** | (2006.01) |
| ***E01B 7/22*** | (2006.01) |
| ***E01B 9/28*** | (2006.01) |
| ***E01B 9/68*** | (2006.01) |
| *E01B 1/00* | (2006.01) |

(52) U.S. Cl.

CPC ... *E01B 9/00* (2013.01); *E01B 7/22* (2013.01); *E01B 9/28* (2013.01); *E01B 9/685* (2013.01); *E01B 1/004* (2013.01)

(58) Field of Classification Search

CPC ..... D01B 9/00; D01B 7/22; D01B 9/28; D01B 9/685; D01B 1/004

See application file for complete search history.

(56) References Cited

U.S. PATENT DOCUMENTS

| | | | | |
|---|---|---|---|---|
| 2,235,776 | A * | 3/1941 | Rushing | E01B 7/22 238/305 |
| 2,465,802 | A * | 3/1949 | Hays | E01B 7/22 238/288 |
| 6,422,479 | B1 * | 7/2002 | Adkins | E01B 11/54 238/288 |
| 9,234,314 | B2 * | 1/2016 | Habel | E01B 5/16 |
| 2010/0044451 | A1 * | 2/2010 | Dufresne | C08J 5/04 238/280 |
| 2015/0337499 | A1 * | 11/2015 | Sackler | E01B 7/22 238/310 |

FOREIGN PATENT DOCUMENTS

| | | | |
|---|---|---|---|
| EP | 1033436 | A1 | 9/2000 |
| FR | 2482990 | A1 | 11/1981 |

* cited by examiner

*Primary Examiner* — Jason C Smith
(74) *Attorney, Agent, or Firm* — Lucas & Mercanti, LLP

(57) ABSTRACT

A device for fastening a rail to a carrier, wherein the device has a first fastening element, which can be anchored to the carrier, and a second fastening element, which can be anchored to the carrier and has a rest face for a rail foot. The first and second fastening elements each have a contact face, which is formed in a concave manner in the first fastening element and in a mirror-inverted, convex manner in the second fastening element.

12 Claims, 6 Drawing Sheets

DEVICE FOR FASTENING A RAIL TO A CARRIER

The present application is a 371 of International application PCT/EP2013/061872, filed Jun. 10, 2013, which claims priority of DE 10 2012 013 286.7, filed Jul. 5, 2012, the priority of these applications is hereby claimed and these applications are incorporated herein by reference.

BACKGROUND OF THE INVENTION

The invention relates to a device for fastening a rail to a carrier.

Rail fasteners consist, especially in the region of switches, of numerous complicated and costly small parts. For local transportation routes, use is made of ties provided with anchoring rails, and the rail fastener can be fastened variably to the tie by way of these anchoring rails. Successive rail fasteners can thus be fixed in a slightly skewed manner with respect to one another.

In order to position the rail flexibly with respect to the carrier, all conventional rail fasteners have a component that consists of a number of individual parts and has a slot through which the horizontal load dissipation takes place. This slot allows rotation of the rail fastener within certain limits with respect to the carrier. In this way, rails in the region of switches can be fastened in a non-perpendicular position with respect to the longitudinal axis of the carrier, which can be in the form for example of a track slab or tie. However, the slot provided in conventional components results in a considerable reduction in vertical load introduction when a fastening means, for example a hammer-head bolt, is tightened. Since in practice the fastening means are frequently tightened excessively during fitting, the anchor rail can pull out, with the result that the corresponding tie becomes unusable.

SUMMARY OF THE INVENTION

Therefore, the invention is based on the object of specifying a device for fastening a rail to a carrier, by way of which a high pressure force can be achieved such that the vertical load transmission between the anchoring rail and the fastening device is as high as possible.

In order to achieve this object, in the case of a device of the type mentioned at the beginning, provision is made according to the invention for said device to have a first fastening element that is anchorable on the carrier and a second fastening element that is anchorable on the rail and has a support surface for a rail foot, wherein the first and the second fastening element each have a contact face which is formed in a concave manner in the case of the first fastening element and is formed in a mating convex manner in the case of the second fastening element.

The fastening device according to the invention has two complementary fastening elements which allow the desired rotation of the rail relative to the carrier. The second fastening element, which has the support surface for the rail foot, absorbs horizontal forces which arise during train operation, and at the same time the second fastening element is anchored on the carrier so that vertical loads can be absorbed. The two contact faces which are formed on the first and second fastening elements are matched to one another such that variable positioning of the second fastening element is possible, and in this way the rail can be fastened to the carrier in a manner that deviates from a position at right angles.

With regard to the contact faces of the fastening elements, it is preferred in the case of the device according to the invention for said fastening elements to be in the form of segments of a circle. The contact faces can have an angular range of for example 30°-90°, such that even in the case of a position of the rail with respect to the carrier that deviates considerably from the position at right angles, sufficient transmission of force via a contact surface formed between the two contact faces is possible.

In the device according to the invention, it is particularly preferred for the second fastening element to be attachable to the carrier so as to be rotatable about a fastening point. This fastening point allows load dissipation in the vertical direction, and the fastening point is in this case designed such that a high vertical force can be transmitted.

It is also in the scope of the invention for the first and/or the second fastening element to be attachable to an undercut groove in the carrier by means of a hook bolt and/or a hammer-head bolt.

The carrier, which can be in the form of a tie or track slab, has embedded in its top side an undercut groove in which the head of a hook bolt or a hammer-head bolts can be supported. Preferably, both the first and the second fastening element are anchored in the groove in the carrier.

A particularly reliable function arises when the first and/or the second fastening element has a circular opening for a fastening element. Preferably, the fastening element can be in the form of a bolt, hook bolt or hammer-head bolt. Since the fastening elements have a circular opening, that is to say a through-hole, it is possible to dispense with the slot which is present in conventional rail fasteners and has proved in practice to have little resistance to loads. On account of the circular opening, maximum load dissipation between the anchoring rail with the undercut groove and the fastening element is ensured.

A further improvement can be achieved in the device according to the invention by the first fastening element having on its underside a protrusion that is insertable into the groove in the carrier. This protrusion is matched to the shape and size of the groove and prevents the first fastening element from twisting. According to one development of the invention, provision can be made for a holding-down means for a rail foot sheathing to be arranged on the top side of the second fastening element. The holding-down means surrounds the rail foot and at the same time reduces the transmission of vibrations originating from train operation to the underlying surface.

In addition, the invention relates to a rail arrangement comprising a rail which is arranged on a carrier in the form of a reinforced concrete tie or track slab. The rail arrangement according to the invention is distinguished by the fact that the rail is fastened to the carrier by means of devices which are arranged on both sides of the rail.

Preferably, the first and second fastening elements can consist of a plastics material, in particular of polyamide.

Further advantages and details of the invention are explained in the following text by way of an exemplary embodiment with reference to the drawings. The drawings are schematic illustrations in which:

DETAILED DESCRIPTION OF THE INVENTION

Figure 1:
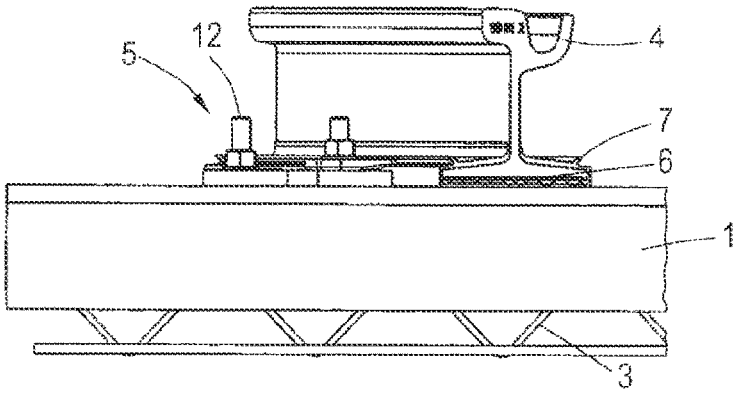
FIG. 1 shows a side view of a rail arrangement according to the invention having a fastening device according to the invention.

In the following text, the rail arrangement and the device for fastening a rail to a carrier are explained with reference to FIGS. 1 to 5.

In the exemplary embodiment illustrated, the carrier is in the form of a reinforced concrete tie 1 which has a plurality of tension wires 2 and a reinforcing mesh 3 that protrudes from the underside. The reinforced concrete tie 1 is cast in concrete during the production of a rail trackway. A rail 4 is fixed to the top side of the reinforced concrete tie 1 by means of fastening devices 5. For reasons of clarity, only one side of the fastening device 5 is illustrated in the drawings, but the fastening devices 5 are always used in pairs in order to support the rail 4 from both sides.

The rail 4 is provided for local transportation, but in principle the fastening device 5 is not restricted thereto since any type of rails 4 can be fastened with the fastening device 5.

The rail 4 has a rail foot 6 which is surrounded by a rail foot sheathing 7. The rail foot sheathing 7, which consists of an elastomer, prevents the transmission of oscillations and vibrations from the rail 4 to the reinforced concrete tie 1 and the underlying surface.

The reinforced concrete tie 1 has on its top side an embedded anchoring rail 8 through which an undercut groove is formed. The anchoring rail 8 is formed integrally with the reinforced concrete tie 1.

Figure 2:
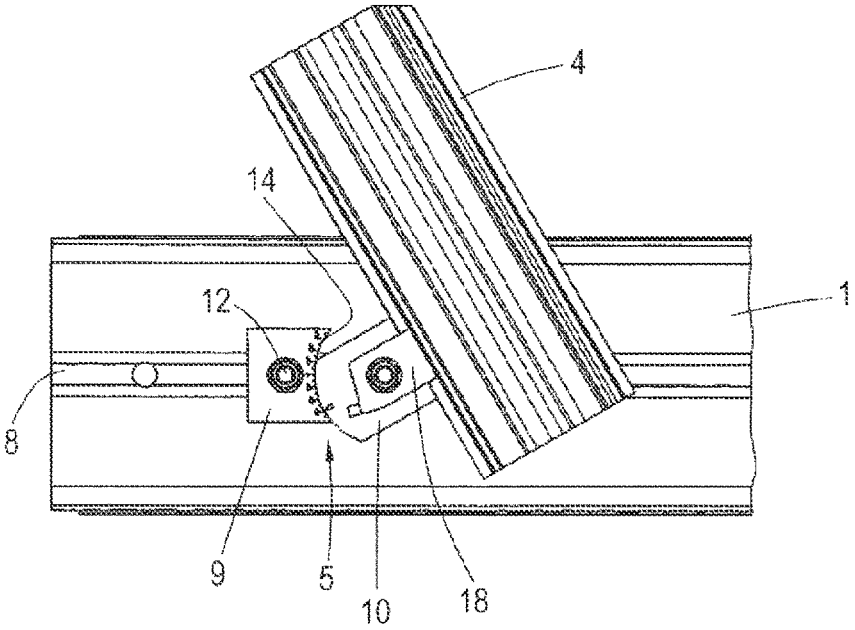
FIG. 2 shows a plan view of the rail arrangement from FIG. 1.
Figure 3:
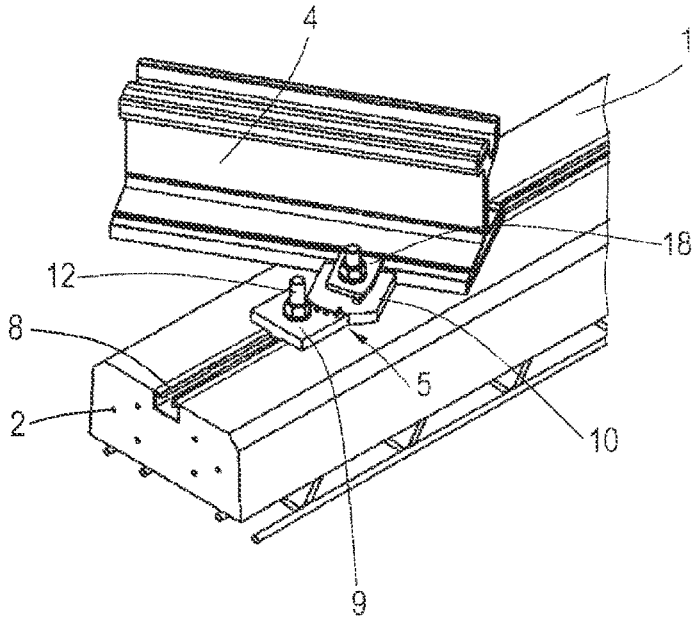
FIG. 3 shows a perspective view of the rail arrangement from FIG. 1.
Figure 4:
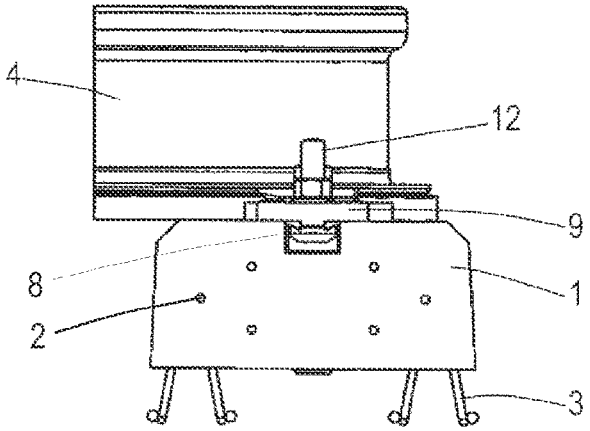
FIG. 4 shows a sectional view, rotated through 90° with respect to the view in FIG. 1, of the rail arrangement from FIG. 1.
Figure 5:
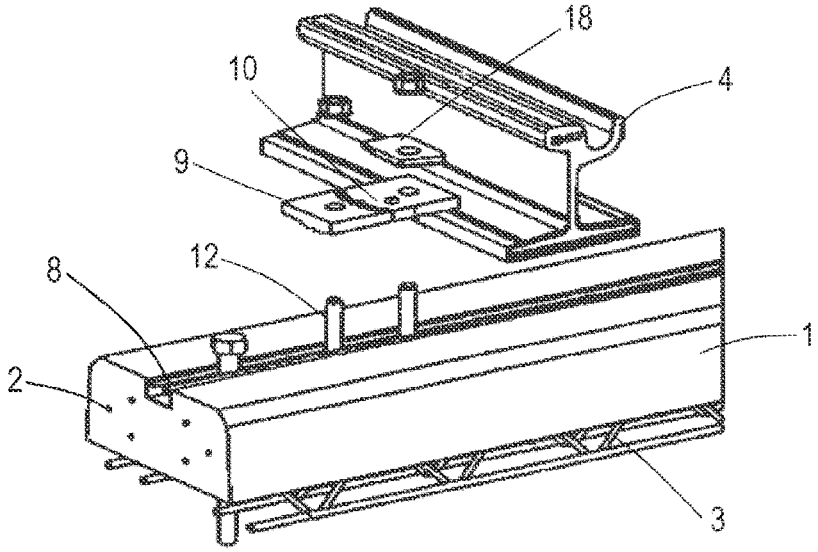
FIG. 5 shows an exploded illustration of the individual components of the rail arrangement from FIG. 1.
Figure 6:
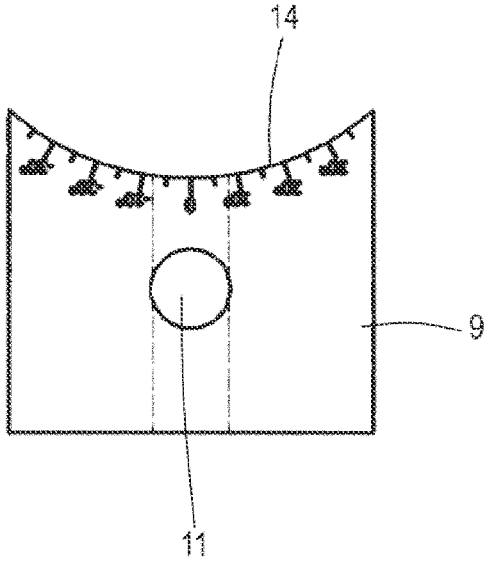
FIG. 6 shows a plan view of the first fastening element.
Figure 7:
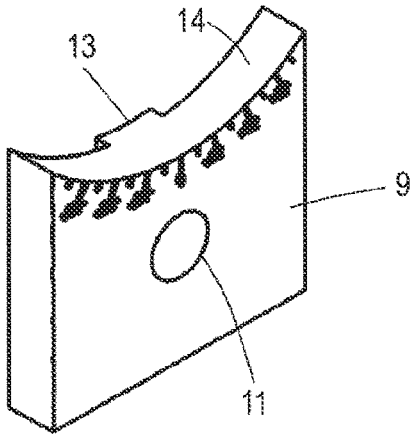
FIG. 7 shows a perspective view of the fastening element from FIG. 6.
Figure 8:
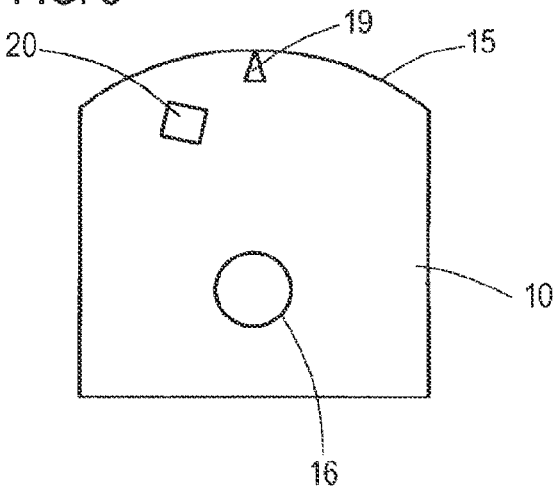
FIG. 8 shows a plan view of the second fastening element.
Figure 9:
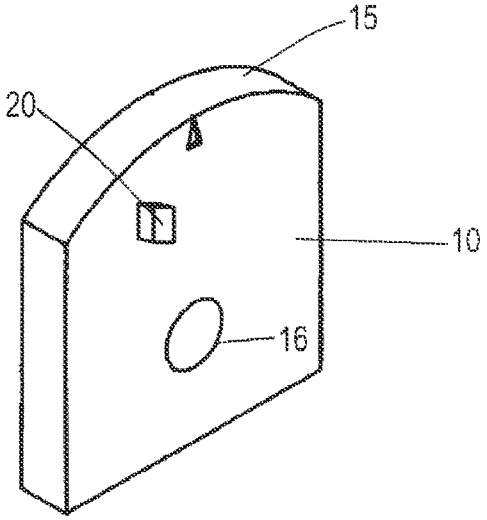
FIG. 9 shows a perspective view of the fastening element from FIG. 6.

The rail 4 is fastened to the reinforced concrete tie 1 by means of the fastening devices 5, wherein a fastening device 5 has a first fastening element 9 and a second fastening element 10. The plan view in FIG. 2 shows that the two fastening elements 9, 10 have a common contact surface. The first fastening element 9 has a concave contact face 14 which is in the form of a segment of a circle. The first fastening element 9 is formed in a substantially plate-like manner and has a circular opening 11 which is shown in FIG. 6. The first fastening element 9 is fastened to the reinforced concrete tie 1 by means of a hammer-head bolt 12 which is pushed into the anchoring rail 8 in an inverted manner, that is to say with the head directed downward. Subsequently, the first fastening element 9 is fitted on the shank of the hammer-head bolt 12 and screwed together therewith. FIG. 7 shows that the first fastening element 9 has a protrusion 13 on its side which is the lower side in the mounted state. The cuboidal protrusion 13 extends parallel to side faces of the first fastening element 9 and the width of the protrusion 13 chosen so that the protrusion can be inserted into the groove in the anchoring rail 8. The protrusion 13 serves as twist prevention, since it prevents the first fastening element 9 from twisting when the hammer-head bolt 12 is tightened.

The second fastening element 10 has a contact face 15 that is formed in a convex manner and is formed in a mating manner with respect to the concave contact face 14 of the first fastening element 9. Both contact faces 14, 15 are in the form of segments of a circle and have the same radius. The second fastening element 10 has a circular opening 16 through which it is fastened. Fastening likewise takes place with a hammer-head bolt 12 which is fitted through the opening 16 in the second fastening element 10 and which is screwed together with a nut.

On the top side of the second fastening element 10, there is a holding-down means 18 which bears against the rail foot sheathing 7 with one side and keeps the rail 4 in position.

In the region of a switch, adjacent ties are at slightly different angles to the rail. During mounting, the ties and the rails are positioned along the planned route and subsequently the two fastening elements 9, 10 are mounted. While the first fastening element 9 is always mounted in the same position on account of the protrusion 13 on its underside, the position of the second fastening element 10 changes depending on the particular angle between the reinforced concrete tie 1 and the rail 4. The angular difference is compensated by the two contact faces 14, 15 of the two fastening elements 9, 10. The holding-down means 18 is located on the top side of the second fastening element 10 and clamps the rail 4 and the rail foot sheathing 7.

Applied to the top side of the first fastening element 9 is a scale having an angle graduation and on the top side of the second fastening element 10 there is a marking 19 so that the angle formed between the reinforced concrete tie 1 and the rail 4 can be read off. On the top side of the second fastening element 10 there is a quadrangular protrusion 20 which prevents the holding-down means 18 from twisting during mounting.

Not only does the construction of the fastening device 5 ensure twist prevention by way of the first fastening element 9, but also both vertical forces, which result from the holding down of the rail, and horizontal forces, which result from the train travelling along curves, are dissipated into the rail.

The fastening device can be adapted to all current systems which hold down rails. Accordingly, all current holding-down mechanisms with different fasteners can be fitted. Height adjustment for solid tracks can be implemented, by varying the height of the fastening elements 9, 10.

The fastening device 5 is suitable both for ballasted ties and for solid tracks, for example for the RHEDA City system provided by the applicant.

On account of the use of the fastening elements 9, 10 produced from polyamide together with the rail foot sheathing 7 produced from an elastomer (rubber), full electrical insulation of the rail from the tie is ensured. In addition, the holding-down mechanism for the rail is also embodied in a manner electrically insulated from the hammer-head bolt.

As a result of the shaping of the first fastening element, a maximum permissible torque can be applied to the nut or the combination of the hammer-head bolt 12 and the associated nut. Therefore, nuts having securing means such as an adhesive securing means or a mechanical securing means can also be used. These secured nuts require an increased torque.

Figure 10:
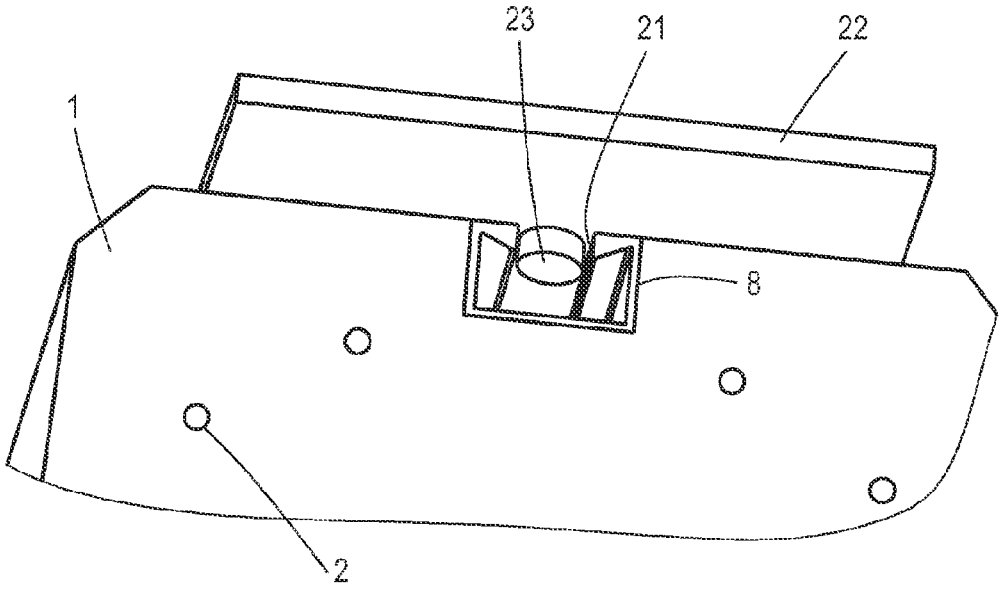
FIG. 10 shows a perspective view of a tie having an elastic intermediate layer.
Figure 11:
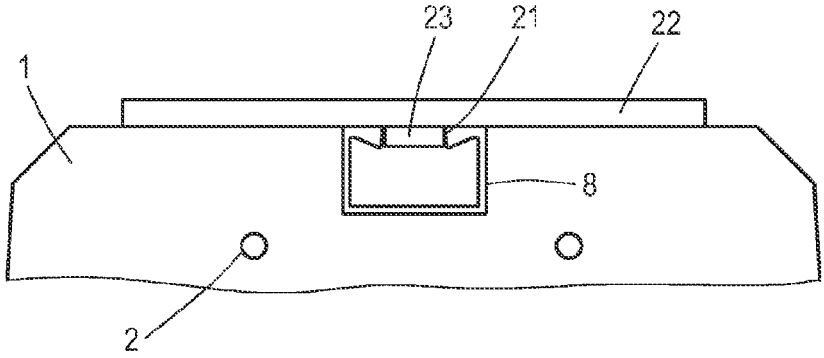
FIG. 11 shows a sectional view of the tie with the intermediate layer from FIG. 10.
Figure 12:
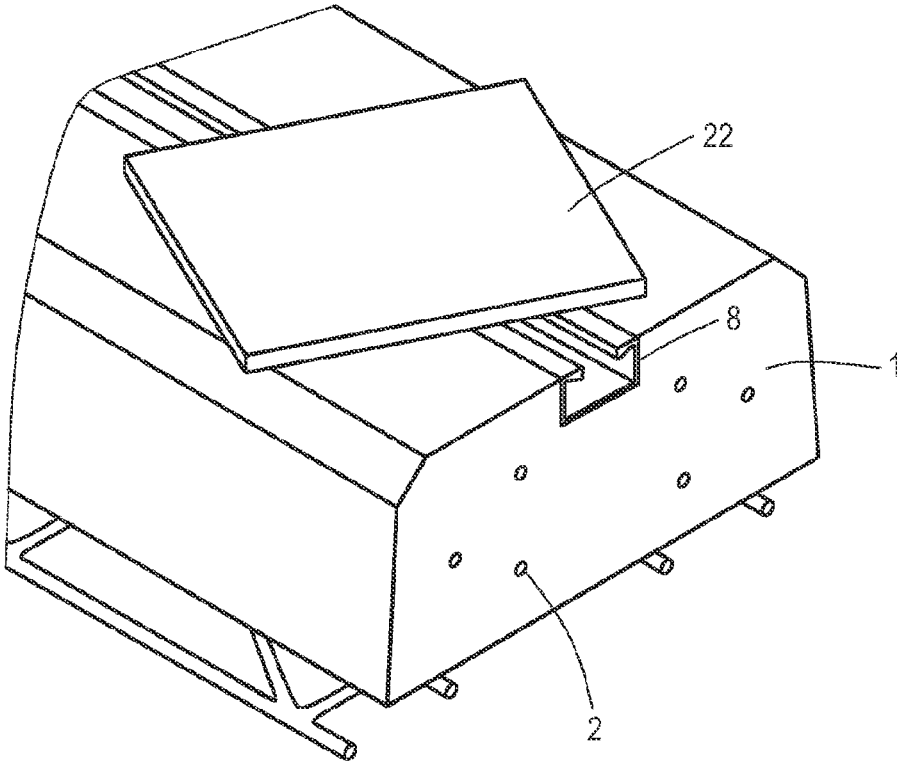
FIG. 12 shows a further perspective view of the elastic intermediate layer arranged on a tie.

FIG. 10 shows the reinforced concrete tie 1, which has the embedded anchoring rail 8 on its top side, and to this extent the reinforced concrete tie 1 is the same as the one in the preceding exemplary embodiment. FIG. 10 shows that an elastic intermediate layer 22 has been inserted into the groove

21 formed by the anchoring rail 8. The elastic intermediate layer 22 has a rectangular outline and formed on its underside is a cylindrical protrusion 23 which extends perpendicularly downward from the elastic intermediate layer 22. The elastic intermediate layer 22 and the protrusion 23 are formed integrally with one another and are produced from an elastomer. In other embodiments, the intermediate layer and the protrusion can also be formed in two or more parts and subsequently assembled. On account of the protrusion 23, the elastic intermediate layer 22 is fixed centrally on the reinforced concrete tie 1, with the result that rotation-free positioning on the reinforced concrete tie 1 is enabled. The rail foot of the rail (not illustrated) is arranged on the elastic intermediate layer 22 so that the elastic intermediate layer 22, which is also known as a pad, can be fixed in an angle-independent manner beneath the rail. With this mounting, it is possible to dispense with further elastic intermediate layers which are conventionally arranged between rail fastening means and the underside of the rail foot.

The transverse forces that act on the intermediate layer 22 are dissipated via the rail fasteners (not illustrated). The round, central fixing of the elastic intermediate layer 22 allows unrestricted use in the fastening device shown in FIGS. 1-9, and in addition it can also be used in other conventional fastening systems. On account of the "rotatability", the action of a loss prevention device and a slip prevention device is achieved at the same time.

The invention claimed is:

1. A device for fastening a rail to a carrier, wherein the device has a first fastening element that is anchorable on the carrier and a second fastening element that is anchorable on the carrier and has a support surface for a rail foot, wherein the first and the second fastening element each have a contact face which is formed in a concave manner in the case of the first fastening element and is formed in a mating convex manner in the case of the second fastening element, wherein the first and/or the second fastening element has a circular opening for a fastener, and wherein the first fastening element has on its underside a protrusion that is insertable into a groove in the carrier.

2. The device as claimed in claim 1, wherein the contact faces of the fastening elements are in the form of segments of a circle.

3. The device as claimed in claim 1, wherein the second fastening element is attachable to the carrier so as to be rotatable about a fastening point.

4. The device as claimed in claim 1, wherein the groove in the carrier is an undercut groove and the first and/or the second fastening element is or are attachable to the undercut groove in the carrier by means of a hook bolt or a hammerhead bolt.

5. The device as claimed in claim 1, wherein a holding-down means for a rail foot sheathing or an intermediate layer is arranged on the top side of the second fastening element.

6. A rail arrangement, comprising a rail which is arranged on a carrier in the form of a reinforced concrete tie or track slab, wherein the rail is fastened to the carrier by means of devices as claimed in claim 1, which are arranged on both sides of the rail.

7. The rail arrangement as claimed in claim 6, wherein the first and second fastening elements consist of a plastics material.

8. The rail arrangement as claimed in claim 7, wherein the plastics material is polyamide.

9. The rail arrangement as claimed in claim 6, wherein the carrier has on its top side the groove into which an elastic intermediate layer that is fixed in terms of its position is inserted, said intermediate layer having on its underside a protrusion adapted to the width of the groove.

10. The rail arrangement as claimed in claim 9, wherein the protrusion is cylindrical and arranged substantially centrally on the underside of the elastic intermediate layer.

11. The rail arrangement as claimed in claim 9, wherein the elastic intermediate layer is freely rotatable.

12. The device as claimed in claim 1, wherein the fastener is a bolt.

* * * * *